US009593905B2

(12) United States Patent
Tseng

(10) Patent No.: US 9,593,905 B2
(45) Date of Patent: Mar. 14, 2017

(54) PULL RING FOR AIR CONTAINER OF AIRSOFT GUN

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 0 days.

(21) Appl. No.: 14/691,590

(22) Filed: Apr. 21, 2015

(65) Prior Publication Data

US 2015/0226517 A1 Aug. 13, 2015

(51) Int. Cl.
*F41B 11/52* (2013.01)
*F41B 11/62* (2013.01)

(52) U.S. Cl.
CPC ..... *F41B 11/62* (2013.01)

(58) Field of Classification Search
CPC ..... F41B 11/62; B63C 9/19
USPC ..... 124/76, 74
See application file for complete search history.

(56) References Cited

U.S. PATENT DOCUMENTS 2,120,248 A * 6/1938 Hinchman ..... F16K 13/04 141/329
2,777,391 A * 1/1957 McNally ..... F41B 11/62 102/376
3,084,833 A * 4/1963 Kline ..... F41B 11/62 124/40
3,180,524 A * 4/1965 Shepard ..... B63C 9/24 137/72
3,970,007 A * 7/1976 Klein ..... F42C 15/32 102/200
3,997,079 A * 12/1976 Niemann ..... B63C 9/24 222/5
4,058,862 A * 11/1977 Stevens ..... B63C 9/00 441/85
4,475,664 A * 10/1984 Mackal ..... B63C 9/24 222/5
4,644,930 A * 2/1987 Mainhardt ..... F41A 11/02 124/58
5,020,395 A * 6/1991 Mackey ..... B67B 7/08 141/19
5,230,324 A * 7/1993 Van Horssen ..... F41B 11/723 124/61
5,341,790 A * 8/1994 Ebert ..... F41B 11/723 124/69
5,488,946 A * 2/1996 Calhoun ..... A62B 9/006 128/205.21
5,505,188 A * 4/1996 Williams ..... F41B 11/52 124/49

(Continued)

*Primary Examiner* — Stephen M Johnson
*Assistant Examiner* — Joshua Semick

(57) ABSTRACT

A containing device includes a container; a compressed gas source in the container and including a sealed opening; a channel member having a first end releasably secured to a first end of the container and including through holes; a hollow closure member releasably secured to a second end of the container; a hollow striker including a projection and a hollow needle spaced from the opening; and two opposite apertures through a periphery of the projection; a cap releasably secured to a second end of the channel member; a biasing member biased between the cap and an internal space of the striker; and a pull ring inserted through the through holes and the apertures to hold the striker in place in a locked position. A pulling of the pull ring out of the channel member can trigger a release of high-pressure gas.

2 Claims, 6 Drawing Sheets

(56) References Cited

U.S. PATENT DOCUMENTS

| | | | | | |
|---|---|---|---|---|---|
| 5,643,030 | A * | 7/1997 | Brown | B63C 9/24 | 116/277 |
| 6,026,797 | A * | 2/2000 | Maeda | F41B 11/62 | 124/73 |
| 6,196,255 | B1 * | 3/2001 | Poillucci | F17C 13/084 | 137/255 |
| 6,470,872 | B1 * | 10/2002 | Tiberius | F41B 11/51 | 124/56 |
| 6,619,278 | B1 * | 9/2003 | Lin | F41B 11/62 | 102/440 |
| 6,941,938 | B2 * | 9/2005 | D'Arcy | F41B 11/62 | 124/74 |
| 8,651,195 | B2 * | 2/2014 | Yoshida | A62C 13/64 | 169/30 |
| 8,967,132 | B1 * | 3/2015 | Tseng | B63C 9/22 | 124/71 |
| 9,157,694 | B1 * | 10/2015 | Tseng | F41B 11/62 | |
| 2009/0194087 | A1 * | 8/2009 | Lin | F41B 11/62 | 124/74 |
| 2015/0013656 | A1 * | 1/2015 | Priestley | F42B 6/10 | 124/74 |
| 2015/0300770 | A1 * | 10/2015 | Tseng | F41B 11/62 | 124/75 |

* cited by examiner

PULL RING FOR AIR CONTAINER OF AIRSOFT GUN

BACKGROUND OF THE INVENTION

1. Field of the Invention

The invention relates to airsoft guns and more particularly to a pull ring for an air container of an airsoft gun.

2. Description of Related Art

Conventionally, an airsoft gun has a compressed gas source (e.g., high-pressure air container) for firing pellets. Further, a valve is provided to control pressurized air flowing out of the air container.

While the valve based air pressure control mechanism enjoys its success in the market, continuing improvements in the exploitation of air pressure for air container of airsoft gun are constantly sought.

SUMMARY OF THE INVENTION

It is therefore one object of the invention to provide a containing device comprising a container; a compressed gas source disposed in the container and configured to store pressurized gas, the compressed gas source including a sealed opening; a channel member having a first end releasably secured to a first end of the container and including a plurality of equally spaced through holes on a periphery; a hollow closure member releasably secured to a second end of the container; a hollow striker including a projection and a hollow needle extending out of the projection, the needle being spaced from the opening in a locked position; and two opposite apertures through a periphery of the projection; a cap releasably secured to a second end of the channel member; a biasing member biased between the cap and an internal space of the striker; and a pull ring inserted through one of the through holes and the apertures into another one of the through holes to hold the striker in place in the locked position wherein in response to pulling the pull ring out of the channel member, the striker is unlocked, the biasing member expands to push the striker toward the compressed gas source until the opening is pierced by the needle, the pressurized gas releases through the needle, the through holes, gaps between an inner surface of the container and the compressed gas source, and the closure member.

The above and other objects, features and advantages of the invention will become apparent from the following detailed description taken with the accompanying drawings.

DETAILED DESCRIPTION OF THE INVENTION

Figure 1:
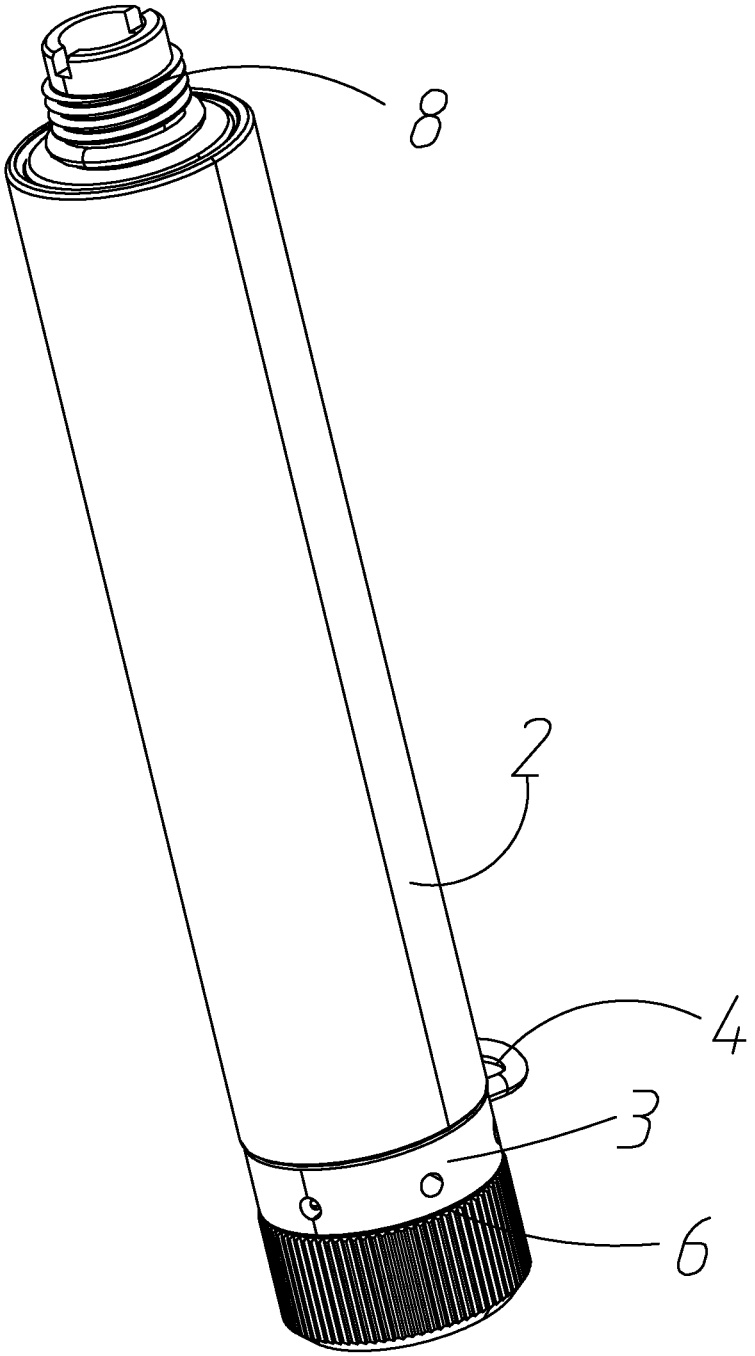
FIG. 1 is a perspective view of an air container for airsoft gun according to the invention.
Figures 2, 2A, 2B:
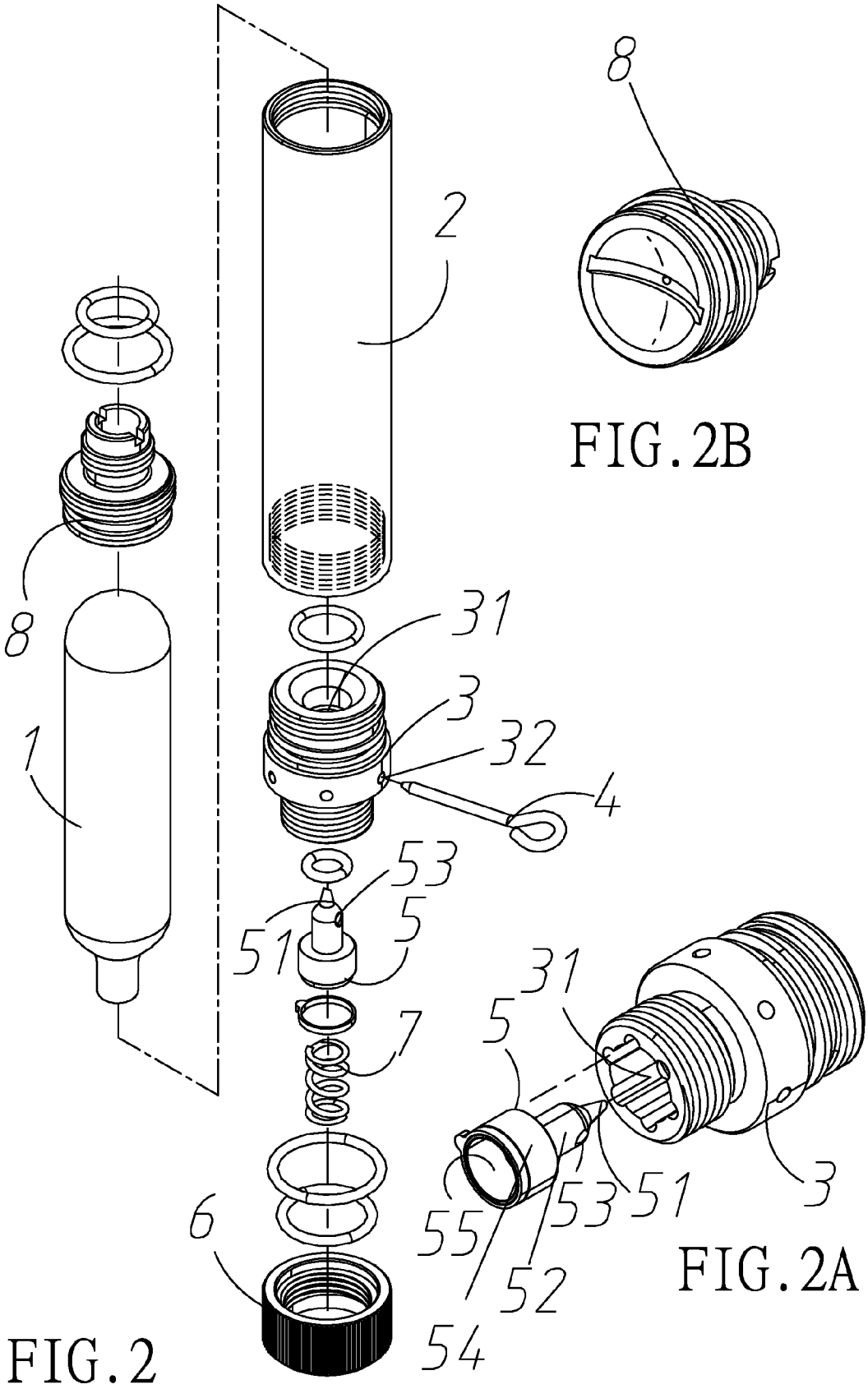
FIG. 2 is an exploded view of the air container.
FIG. 2A is an exploded view of the channel member and the striker.
FIG. 2B is a perspective view of the closure member.
Figure 3:
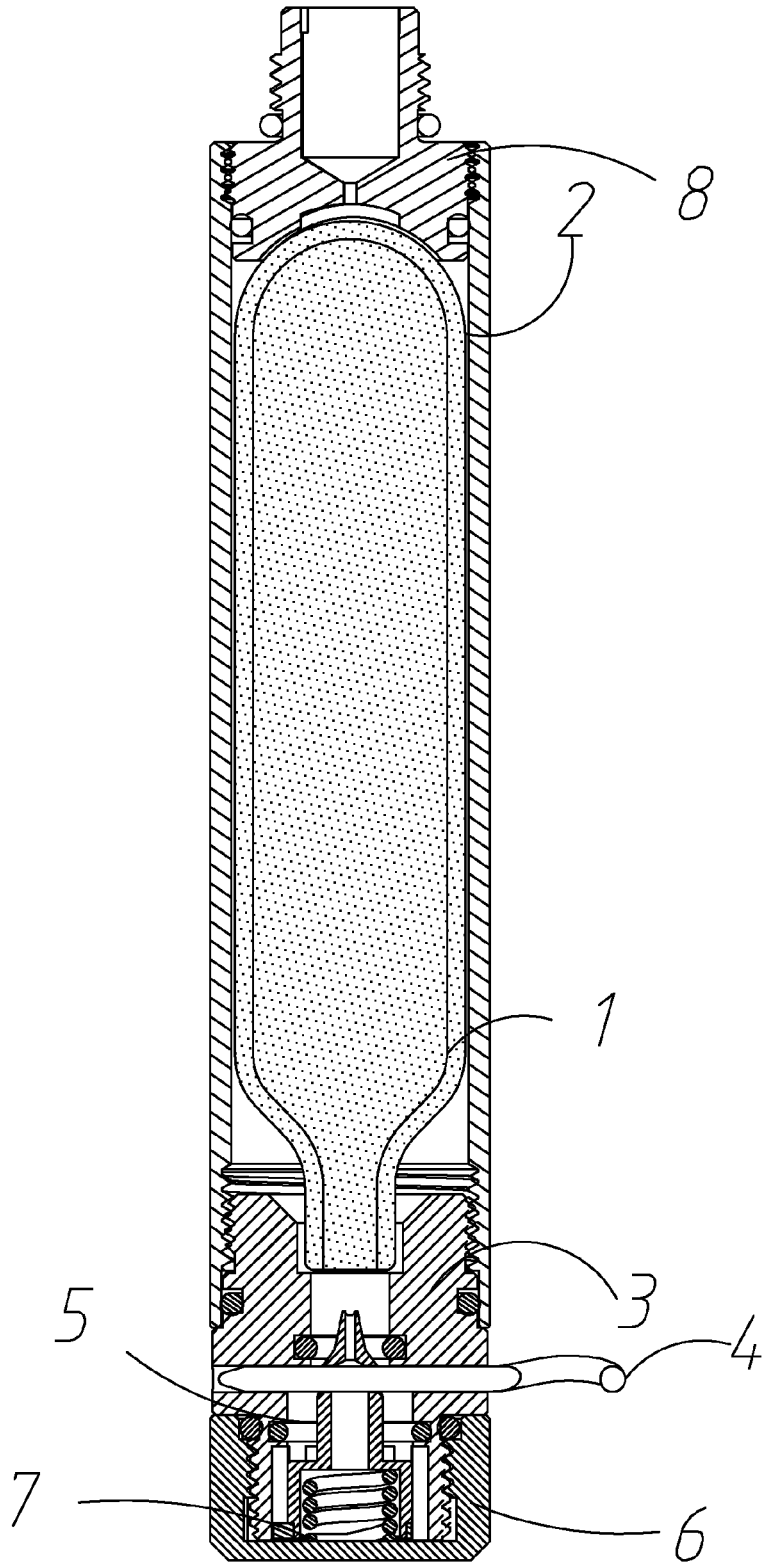
FIG. 3 is a longitudinal sectional view of FIG. 1.
Figure 4:
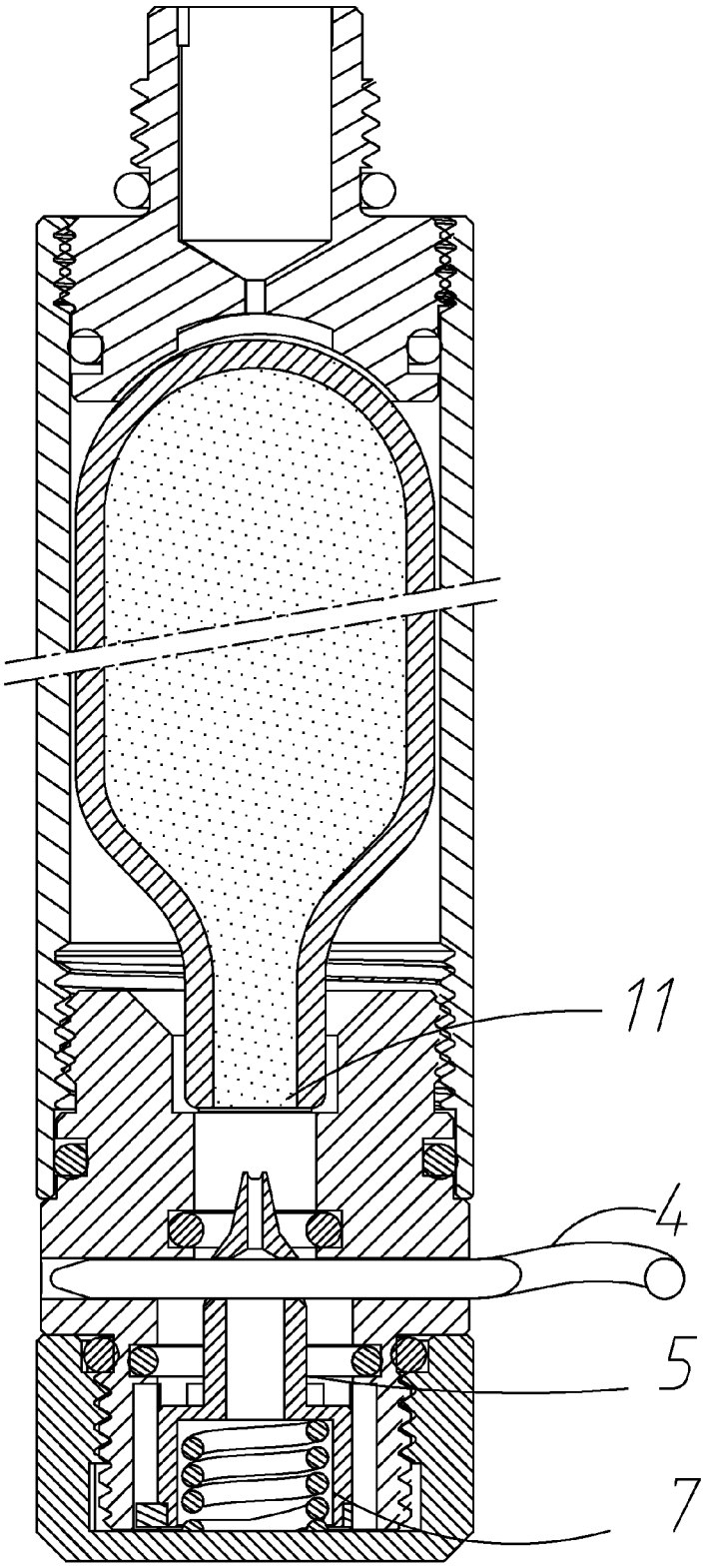
FIG. 4 is an enlarged view of a lower portion of FIG. 3 where the pull ring is disposed in an inoperative position.
Figure 5:
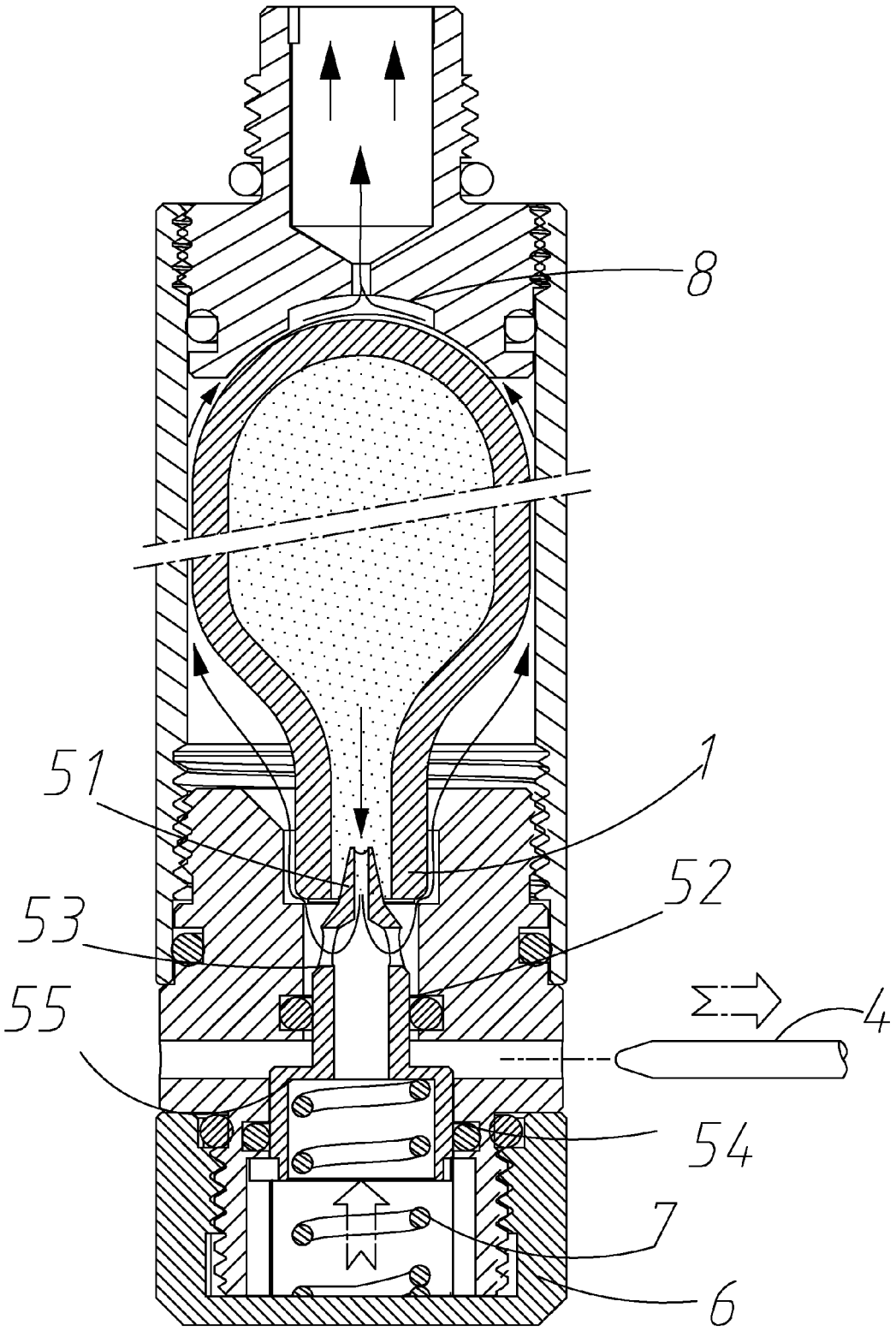
FIG. 5 is a view similar to FIG. 4 where the pull ring has been pulled out.
Figure 6:
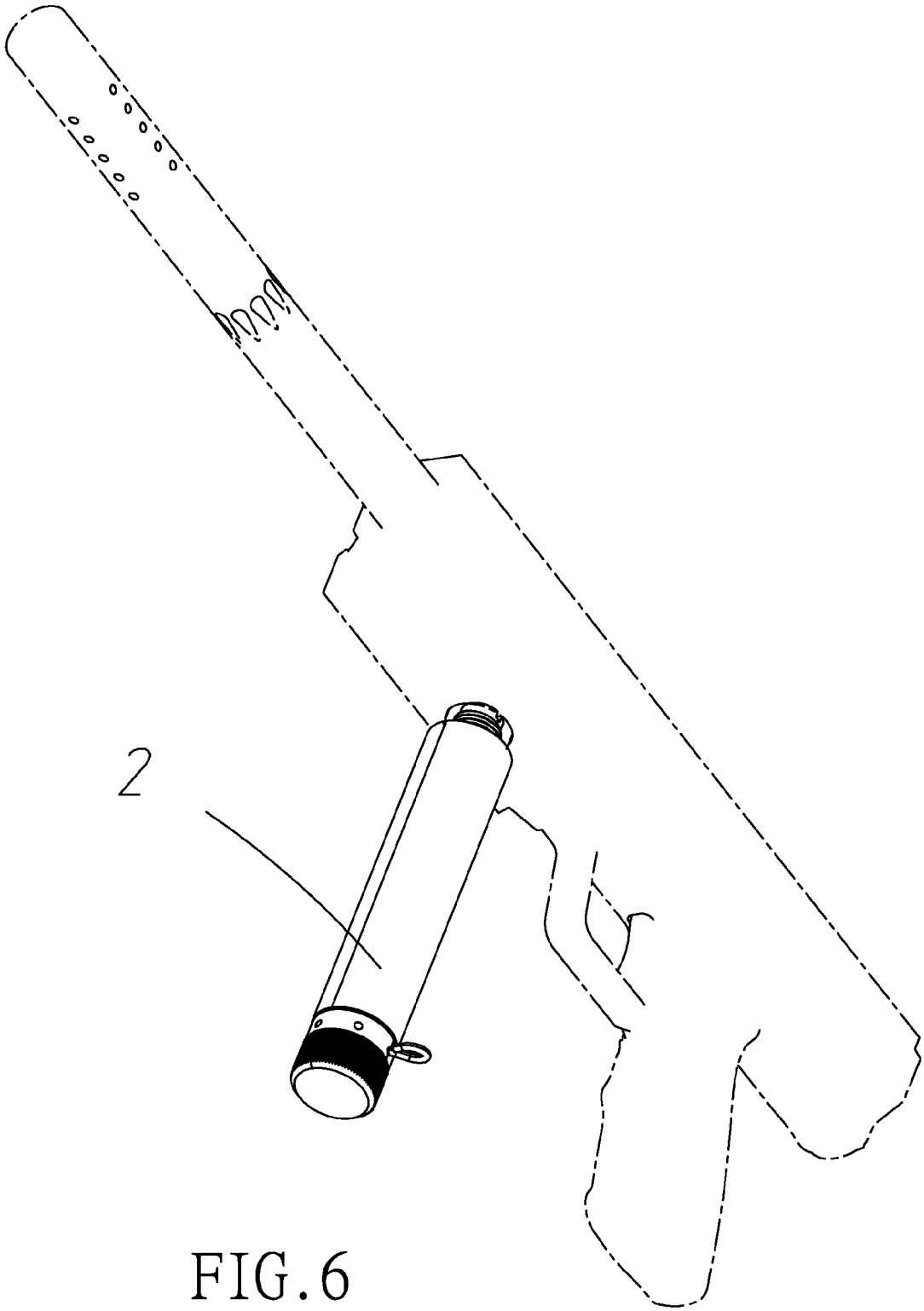
FIG. 6 is a perspective view of the air container attached to an airsoft gun.

Referring to FIGS. 1 to 6, an air container attached to an airsoft gun in accordance with the invention comprises the following components as discussed in detail below.

A cylindrical container 2 is provided. A high-pressure air canister 1 is disposed in the container 2 and has a sealed opening 11. A cylindrical channel member 3 includes an axial passage 31 and a plurality of equally spaced holes 32 on a periphery in which the holes 32 communicate with passage 31 and each hole 32 is aligned with another hole 32. The channel member 3 is threaded secured to one end of the container 2. A hollow, externally threaded closure member 8 is threadedly secured to the other end of the container 2. A hollow striker 5 includes a hollow main body 54, an interior space 55 defined by the main body 54, a projection 52 projecting out of the main body 54, a hollow needle 51 extending out of the projection 52, and two opposite apertures 53 through a periphery of the projection 52. An internally threaded cap 6 is threadedly secured to the other end of the channel member 3. A helical spring 7 is disposed in the space 55 and has an end urging against a bottom of the cap 6 in a compressed state. A pull ring 4 is inserted through one hole 32, the passage 31, the apertures 53, the passage 31 again into the opposite hole 32 to hold the striker 5 in place. Also, the needle 51 is spaced from the opening 11 of the air canister 1 in an inoperative (i.e., locked) position.

In a pressurized air supplying operation for firing a projectile out of an aisoft gun, a user may pull the pull ring 4 out of the channel member 3. The striker 5 is thus free and in turn, the spring 7 expands to push the striker 5 toward the air canister 1 until the opening 11 is pierced by the needle 51. Pressurized air stored in the air canister 1 immediately releases through the needle 51, the holes 53, gaps between an inner surface of the container 2 and the air canister 1, and the closure member 8.

While the invention has been described in terms of preferred embodiments, those skilled in the art will recognize that the invention can be practiced with modifications within the spirit and scope of the appended claims.

What is claimed is:

1. A containing device comprising:

a container;

a compressed gas bottle, disposed in the container, and including a sealed opening;

a channel member having a first end releasably secured to a first end of the container and including a plurality of equally spaced through holes on a periphery;

a hollow closure member releasably secured to a second end of the container;

a hollow striker including a projection and a hollow needle extending out of the projection, the needle being spaced from the opening in a locked position, wherein the projection is of a cylindrical shape, the hollow needle is of a conic shape, and an axial passing hole penetrates the projection and the hollow needle, and two opposite apertures radially penetrate through a periphery of the projection;

a cap releasably secured to a second end of the channel member;

a spring compressed between the cap and the striker; and a pull ring with a pin inserted through two of the through holes and the opposite apertures to hold the hollow striker;

wherein in response to pulling the pull ring out of the channel member, the hollow striker is released, the spring expands to push the hollow striker to pierce the opening of the compressed gas bottle, and gas in the compressed gas bottle flows through the passing hole, the opposite apertures, and gaps between an inner surface of the container, the compressed gas bottle and the closure member.

2. The containing device of claim 1, wherein the striker further comprises a hollow main body with an interior space, the projection protrudes from the main body, and an end of the spring is received in the interior space.

* * * * *